United States Patent [19]

Salmela et al.

[11] Patent Number: 4,494,480

[45] Date of Patent: Jan. 22, 1985

[54] APPARATUS FOR SPREADING A FLUID ONTO A MOVING WEB OF MATERIAL

[76] Inventors: Jouko J. Salmela, Majamäenkatu 6, S-20900 Turku 90; Jukka Hietanen, Kalliokatu 11 B, SF-18100 Heinola 10; Timo Syrjänen, Vuohiniementie 5 B 16, SF-18130 Heinola 13, all of Finland

[21] Appl. No.: 511,754

[22] Filed: Jul. 7, 1983

[30] Foreign Application Priority Data

Jul. 26, 1982 [FI] Finland ..... 822614

[51] Int. Cl.[3] ..... B05C 5/02

[52] U.S. Cl. ..... 118/411; 222/148

[58] Field of Search ..... 118/410, 411, 419; 222/148, 534

[56] References Cited

U.S. PATENT DOCUMENTS 3,650,241 3/1972 North ..... 118/25 X 4,223,633 9/1980 Alvensleben et al. ..... 118/410 X

*Primary Examiner*—John P. McIntosh

*Attorney, Agent, or Firm*—Roylance, Abrams, Berdo & Goodman

[57] ABSTRACT

The invention relates to an apparatus for spreading a fluid onto a moving web of material, especially for spreading size onto a paper web. It is previously known to spread fluid substances onto a moving web of material by means of a comb nozzle. Especially when size is being spread, the size tends to harden during stoppages, thereby clogging the openings of the comb nozzle. The apparatus according to the present invention enables a fluid to be spread onto a moving web of material without the apparatus getting clogged even in a dusty environment. By means of the apparatus it is possible to spread even rapidly drying fluids without the risk of the substance being spread drying in the nozzle opening or openings during stoppages.

The apparatus has an oblong trough, on the circumference of which there is longitudinally an oblong opening and inside or adjacent to the trough a pipe parallel to the longitudinal direction of the trough, the pipe having on its circumference, also longitudinally, one or several openings over a maximum distance of the length of the opening of the trough in order to spread the fluid which is in the pipe via the openings onto a moving web of material, and means for feeding into the pipe the fluid to be spread. In addition the apparatus has means for feeding another fluid and/or a gas into the trough and for removing it from there, and means for transferring the opening or openings of the pipe so as to have connection with the inside of the trough.

13 Claims, 8 Drawing Figures

A – A

B – B

C – C

APPARATUS FOR SPREADING A FLUID ONTO A MOVING WEB OF MATERIAL

FIELD OF THE INVENTION

The present invention relates to an apparatus for spreading a fluid such as size onto a moving web of material, especially a paper web, the apparatus having an oblong trough, on the circumference of which there is longitudinally an oblong opening and inside or alongside of which there is a pipe in the longitudinal direction of the trough, there being on the circumference of the pipe, also longitudinally, one or several openings at maximum over the distance of the trough opening, in order to spread the fluid in the pipe via the openings onto a moving web of material, and means for feeding into the pipe the fluid which is to be spread.

It is previously known to spread fluid substances onto a moving web of material by means of a comb nozzle which extends across the width of the web of material and into which the fluid is fed under pressure. Owing to the large quantities of dust present in the spreading environment, the openings of the comb nozzle tend, however, to get clogged, thereby causing disturbances in the production. Especially when size is being spread, the size tends to harden during stoppages and to clog the openings of the comb nozzle so that their clearing is very difficult. From French Patent Application No. 2,255,961 there is known an apparatus for coating or impregnating a textile web by means of a fluid substance. In this apparatus the textile web is directed over a cylindrical mantle having longitudinally on its circumference an oblong slit or several successive openings for spreading fluid onto a moving textile web. Inside the cylindrical mantle there is a large-sized longitudinal opening the edges of which are sealed against the inner wall of the outer cylindrical mantle, the fluid to be spread being directed into the open pipe. In this apparatus the outer, cylindrical mantle or the inner, open pipe can rotate, and then the other one is stationary.

The apparatus disclosed in this French Patent Application No. 2,255,961 involves, however, the same problems as are involved in the first-mentioned comb nozzle. Thus, the dust present in the spreading environment tends to clog the openings or slits in the outer, cylindrical mantle, and, especially when size is being spread, the size would tend to dry in the openings of the outer, cylindrical mantle during pauses or stoppages in production.

The object of the present invention is therefore to provide an apparatus for spreading a fluid onto a moving web of material, an apparatus which does not get clogged even under dusty conditions and by means of which it is possible to spread even very rapidly drying fluids without the risk of the substance being spread drying in the openings or slits of the nozzle during pauses.

SUMMARY OF THE INVENTION

According to the invention there is now provided an apparatus having means for feeding gas, vapor or another fluid into the trough and for removing it from there, and means for transferring the opening or openings in the pipe so as to be connected with the inside of the trough.

DESCRIPTION OF THE PREFERRED EMBODIMENTS

Figure 1:
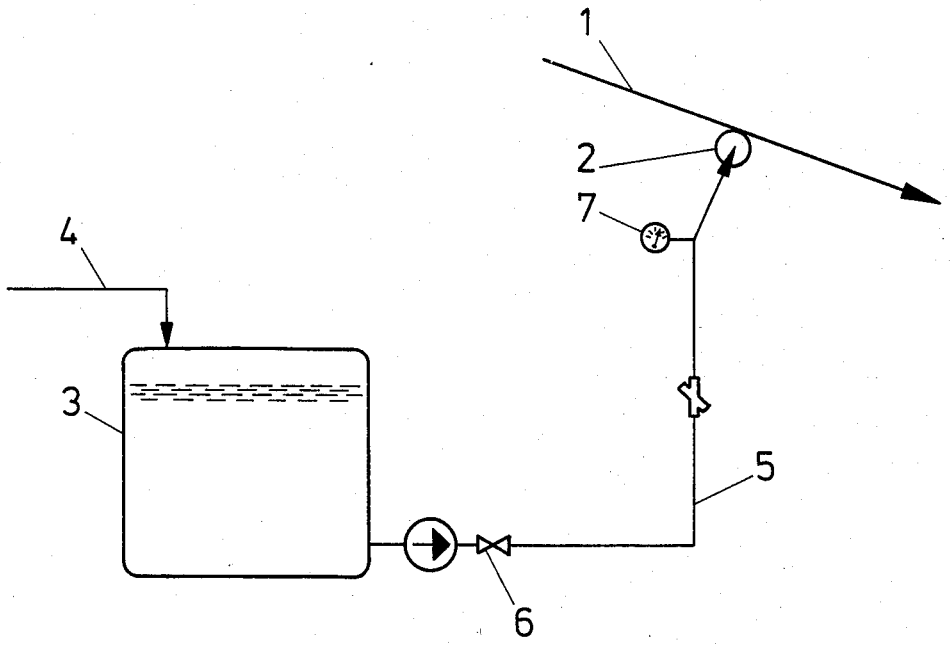
FIG. 1 depicts a schematic side view of an apparatus according to the invention, connected to a tank for storing the fluid to be spread.

Thus, in the present invention a gas is fed into the trough, preferably an inert gas, for example water vapor, which does not react with the fluid being spread, in order to block air, which would harden the fluid being spread, from the inside of the trough, into which the opening or openings of the pipe opens/open when the apparatus is not in use. Alternatively it is possible to fill the trough at least in part with another fluid, such as water, the fluid being preferably selected in such a way that it at least in part dissolves the fluid being spread, such as size, in order to dissolve the size remaining after the spreading in the pipe opening or openings or in their vicinity and in order to clean the openings, when the openings of the pipe have been transferred to inside the mantle so as to be below the surface of the other fluid in it.

The said other fluid, or gas or vapor, can also be used as a heat transfer medium in order to maintain the temperature of the fluid being spread, and possibly also its viscosity, at the desired value.

If a fluid which is simultaneously used as a heat transfer medium is fed into the trough, the feed pipe for this other fluid is preferably connected to the lower part of the trough, at its one end, and an outlet pipe, which can be an overflow pipe, is connected to the upper part of the trough at its opposite end. The overflow pipe is in this case higher up than the opening or openings of the spreading pipe, when the openings, in one of their extreme positions, are drawn into the trough, so that the openings in this position are below the surface of the other fluid in the trough.

The means for transferring the opening or openings of the spreading pipe away from the web of material towards the inside of the trough can be members which rotate around the spreading pipe, about its longitudinal center line, which turn or move the spreading pipe on a plane transverse to its longitudinal direction, and with the aid of which the opening or openings of the spreading pipe can be caused to turn so that they open to inside the trough, and/or the spreading pipe can be moved away from the web of material so as to come closer to the inside of the trough.

The trough can have a separate compartment or conduit for the said other fluid, or gas or vapor, the conduit or compartment having also longitudinally one or several openings at substantially similar intervals as has the spreading pipe, in such a way that the openings in the spreading pipe and in the said compartment or conduit can be brought to face each other for the duration of a pause or stoppage in production. In this embodiment the said other fluid, or gas or vapor, cannot, however, be at the same time used as a heat transfer medium during the spreading. The trough can also be a tank filled with another fluid, the openings of the spreading pipe being immersed under the surface of this fluid for the duration of a pause.

In its simplest embodiment the trough is a conduit fitted tightly against the circumference of a spreading pipe having a circular cross section and being rotatable about its longitudinal center line, the said spreading pipe forming one of the longitudinal walls of the conduit. In this case the opening or openings of the spreading pipe can be brought into contact with the other fluid, or gas or vapor, inside the conduit situated against the circumference of the spreading pipe, by turning the spreading pipe about its longitudinal center line so that the opening or openings of the spreading pipe turns/turn to face the inside of the said conduit. The advantage of this embodiment over the previous one is that the said other fluid, or gas or vapor, can serve as a heat transfer medium to maintain at the correct value during the spreading the temperature and possibly the viscosity of the fluid being spread. Its disadvantage, on the other hand, is that the conduit serving as the mantle does not at the same time protect the opening or openings of the spreading pipe from dust during the spreading. During the spreading the web of material does not, however, release as much dust as when it is dry, and so protection during spreading is not always necessary.

In a preferred embodiment of the invention there are at one or both ends of the spreading pipe reciprocally movable piston means for regulating the effective length of the spreading pipe in accordance with the desired spreading width. The feeding pipes for the material to be spread are in this case connected to the spreading pipe at a point or at points within the smallest effective length of the spreading pipe. Alternatively the fluid to be spread can be fed into the spreading pipe along an axial duct in the rod of the piston or pistons.

In a preferred embodiment of the invention, in which the spreading pipe is inside the mantle-like trough, the opening of the trough is at least as long as the pipe and wide enough for the spreading pipe to fit at least in part between the longitudinal side edges of the trough opening, the opening of the trough being covered by a resilient membrane, which has a slit at a point corresponding to the openings of the pipe. In this case the longitudinal slit in the resilient membrane can in the rest position be closed and the pipe is movable so far into the trough opening that the slit in the membrane covering it opens in front of the pipe opening. In this manner there is obtained not only a tight joint between the spreading pipe and the trough opening but also a tight closing of the trough opening, when the spreading pipe is entirely inside the trough, thus preventing dust from passing into the trough.

For moving the spreading pipe towards the web of material it is possible to install between the spreading pipe and the trough or some other fixed stop a hose or the like which is connected to a regulatable pressure medium source, and means for supporting and guiding the spreading pipe preferably rectilinearly towards the paper web. The pressure of the spreading pipe against the moving web of material can be adjusted precisely and flexibly by adjusting the pressure in the hose.

The spreading pipe can be supported and guided towards the trough opening or openings by means of a linearly movable cradle fitted between the said hose and the spreading pipe, that side of the cradle which faces the pipe having substantially the same radius of curvature as has the outer surface of the pipe. In order to reduce the friction between the spreading pipe turnable about its longitudinal center line and the cradle, the outer surface of the spreading pipe and/or the cradle surface facing the pipe can be coated with polytetrafluorethene or some other slippery material.

The apparatus according to the invention can, of course, also be fitted so as to be in its entirety transferrable towards the web of material and away from it, for example with the aid of hydraulic or pneumatic pistons.

It is evident that several spreading pipes can be fitted successively and/or adjacently in one and the same trough in order to spread different fluids simultaneously or successively onto a moving web of material. In this case the inside of the trough can be divided into successive and/or adjacent compartments in order, for example, to adjust the temperature invidivually for each spreading pipe.

The invention is described below in greater detail with reference to the accompanying drawings.

Figure 2:
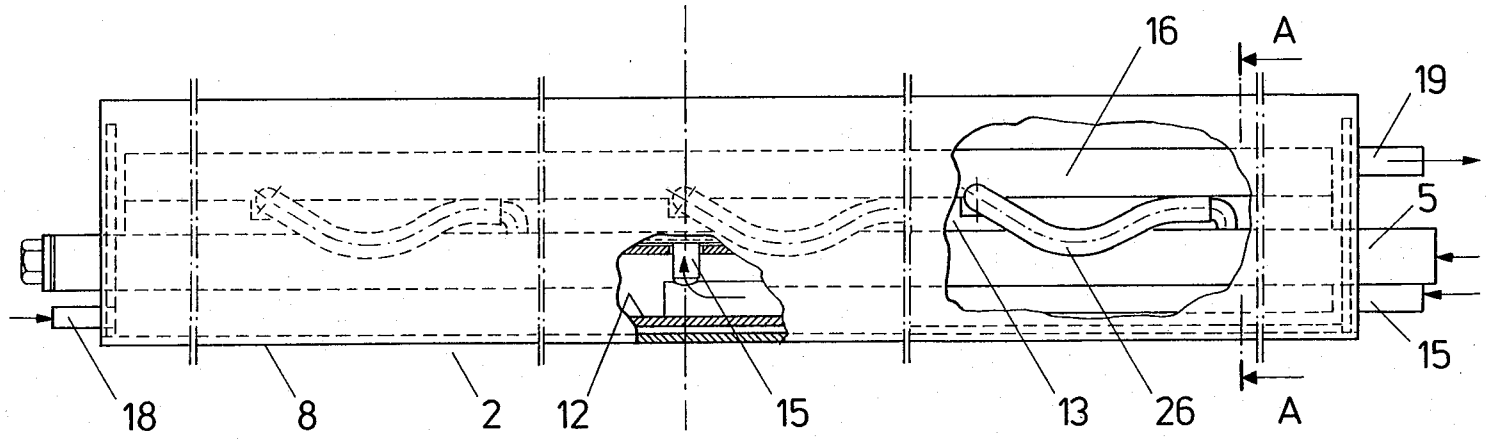
FIG. 2 depicts in greater detail a partially cut side view of a preferred embodiment of the invention.
Figure 3:
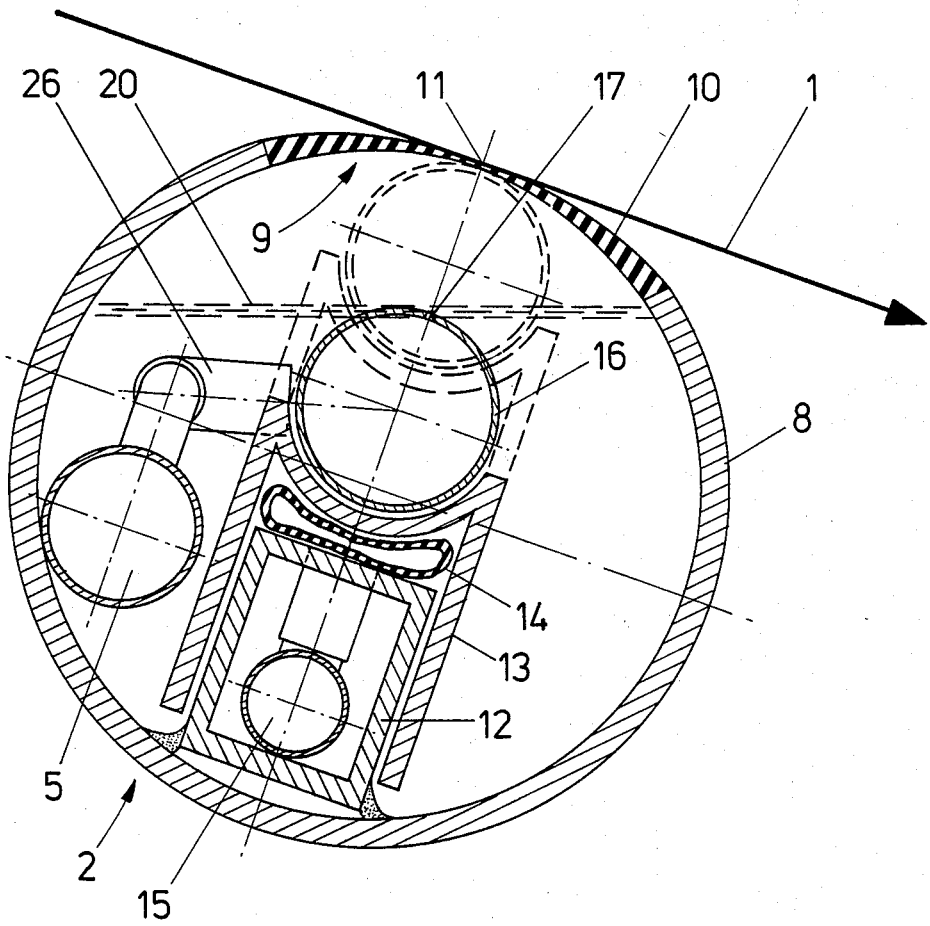
FIG. 3 is a cross section along line A—A in FIG. 2.

In FIG. 1, the moving web is indicated by reference numeral 1, and the spreading apparatus pressed against it from below is in general indicated by numeral 2. The spreading apparatus 2 is connected by means of a pipe 5 to the storage tank 3 for the fluid to be spread, such as size. The size storage tank 3 is kept under pressure by means of air pumped via the conduit 4, and the pressure of the size directed into the spreading device 2 is regulated by means of a valve 6, and the pressure is monitored by means of the meter 7. As can be seen in greater detail in FIGS. 2 and 3, the spreading apparatus consists of a cylindrical trough 8. That part of the circumference of the trough 8 which is to face the paper web 1 has been cut off and the opening 9 thus formed is covered with a membrane 10 of a resilient material having a longitudinal slit 11 parallel to the longitudinal direction of the trough 8.

Inside the trough 8 there is attached to the side diametrally opposite the above-mentioned slit 11 a profile steel 12 with a rectangular cross section, stiffening the trough 8, and on top of the steel 12 there is fitted a cradle 13 which is movable linearly towards and away from the said slit 11, that surface of the cradle 13 which faces the slit 11 being trough-like as seen in the longitudinal direction of the trough 8. Between the cradle 13 and the profile steel 12 serving as its base and guide there is fitted a resilient-walled hose 14, which can be connected via a pipe 15 to an external source of compressed air in order to adjust the volume of the hose 14 and to move the cradle 13 towards and away from the slit.

To the trough-like depression of the cradle 13 there is attached a size-spreading pipe 16, which is thus movable, by means of an increase in pressure in the hose 14, diametrally towards the slit 11 in the membrane 10 covering the opening 9 of the trough 8, to such a degree that both halves of the membrane 10 open in front of the spreading pipe 16, in order to bring it against the moving paper web 1. That part of the spreading pipe 16 which comes against the moving paper web 1 has, furthermore, openings 17 in the longitudinal direction of the pipe 16 at intervals from each other.

The size feed pipe 5 is fitted inside the trough 8 and connected to the size spreading pipe 16 by means of flexible connecting hoses 26. In this manner, size can be directed under pressure into the size spreading pipe 16 and via its openings 17 to the lower surface of the moving web of material. It is evident that size can also be spread onto the opposite surface of the web of material by installing the size spreading apparatus according to the invention above the paper web.

In addition, there is a feed pipe 18 connected to the lower part of one end of the trough 8 in order to introduce water into the trough 8. The water is removed from the trough via an outlet pipe 19 in the upper part of its opposite end. The outlet pipe 19 is connected to the trough 8 at such a point that the water level 20 in the trough 8 settles at such a height that the spreading pipe 16 is entirely below the water surface when it is, in its extreme position depicted in FIG. 3, farthest from the slit 11 in the resilient membrane of the trough 8, the slit being at this time entirely closed in order to prevent dust from passing into the trough 8. When the spreading pipe 16 is below the water surface, the size left in its openings 17 cannot harden and thereby clog the openings. In addition, the water level 20 is preferably so high that even in its upper position, indicated by dotted lines in FIG. 3, the spreading pipe is partially immersed in water, in which case the water can be used as a heat exchange medium for heating or cooling the size during the spreading.

Figure 4:
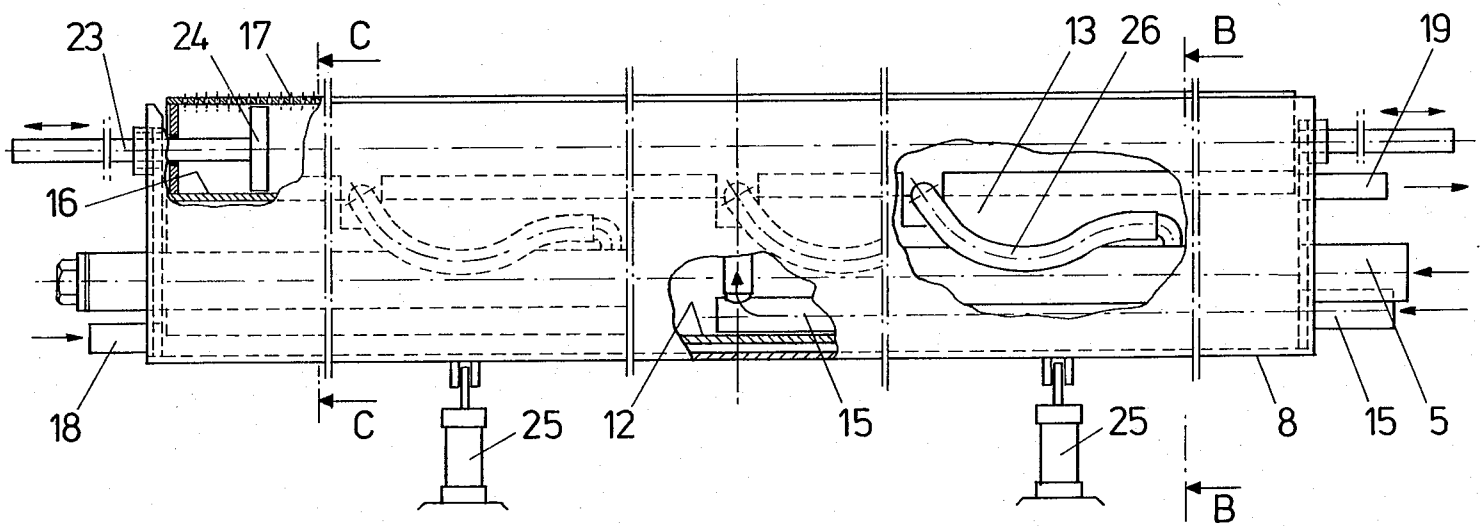
FIG. 4 is a partially cut side view of an alternative embodiment of the invention.
Figure 5:
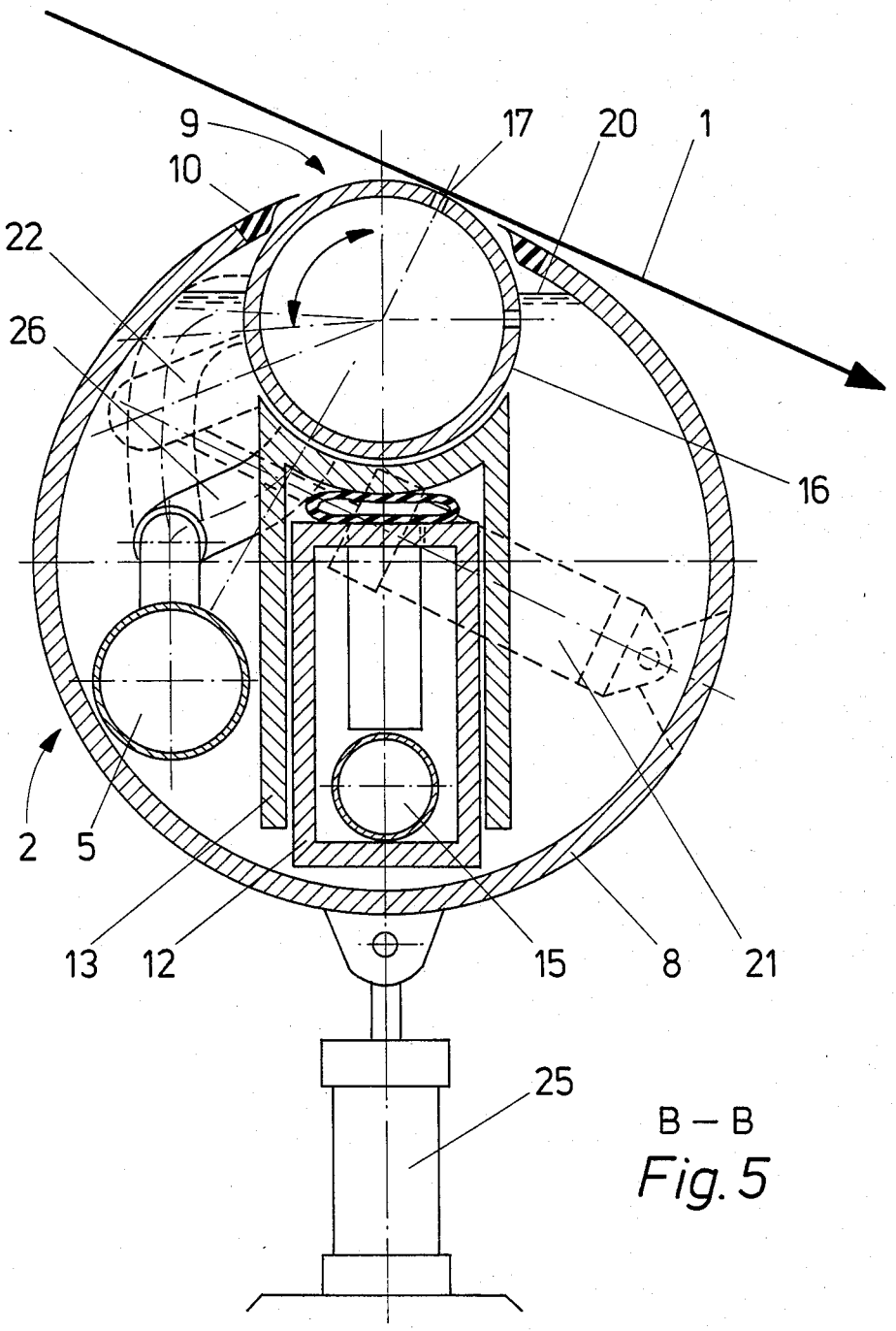
FIG. 5 is a section along line B—B in FIG. 4.
Figure 6:
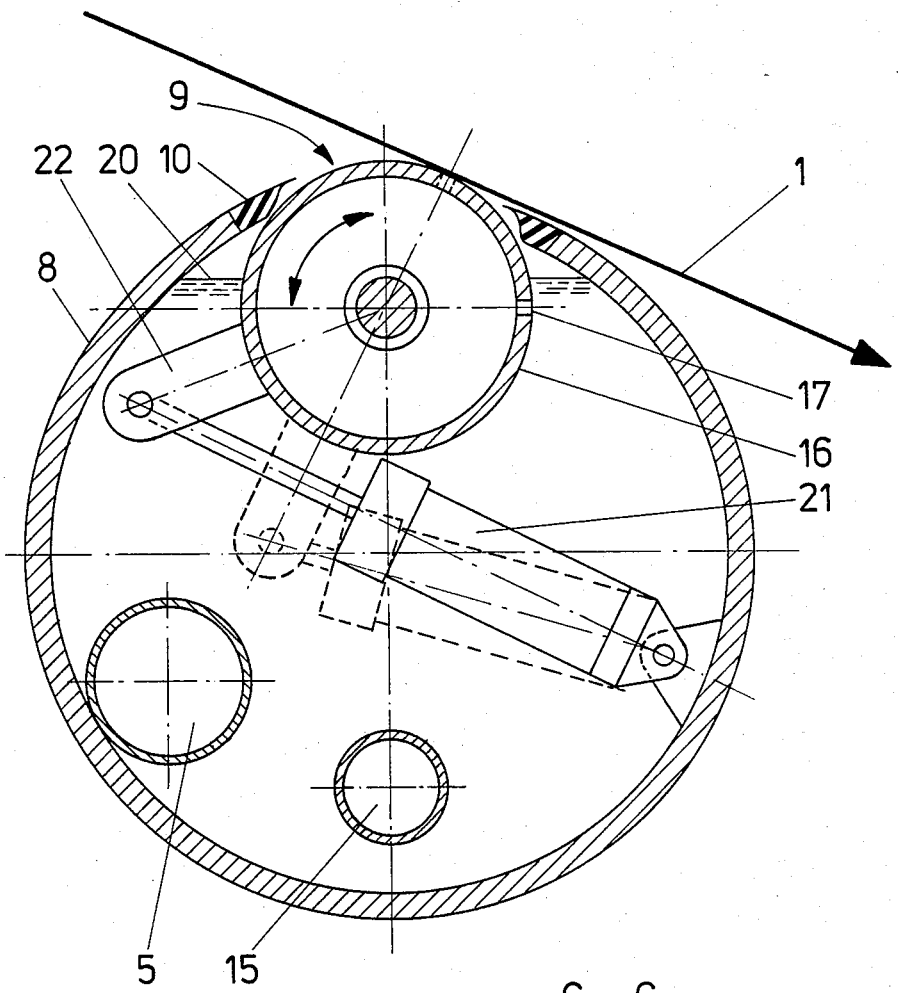
FIG. 6 is a section along line C—C in FIG. 4.

The embodiment depicted in FIGS. 4 and 5 deviates from the above in, for example, that the spreading pipe 16 is fitted in a trough situated in the upper part of the cradle 13, so as to turn about its longitudinal axis. The turning is effected by means of a lever arm 22 attached to the spreading pipe 17 and a working cylinder 21 attached between its one end and the inner surface of the trough 8. By turning the spreading pipe 16 it is possible to transfer its longitudinal row of openings from a position against the moving web of material 1 to below the surface 20 of the water inside the mantle 8. In order to reduce the friction between the outer surface of the spreading pipe 16 and the upper surface of the trough of the cradle 13, the spreading pipe 16 and/or the trough of the cradle 13 can be coated with teflon or some other slippery material.

In this embodiment, the linear movement of the cradle 13, and thereby also that of the spreading pipe 16, is relatively short as compared with the trough, and it is intended only for the fine adjustment of the pressure of the spreading pipe 16 against the moving web of material 1. The actual transfer of the trough 8 towards and away from the web of material 1 is effected by means of working cylinders 25 fitted between the trough 8 and the base.

Deviating from the previous embodiment, the membrane 10 fitted in the opening 9 of the trough 8 does not cover the opening entirely but forms only a resilient seal between the side edges of the opening 9 of the trough 8 and the spreading pipe 16 turnable about its longitudinal center line.

In order to adjust the effective sizing width of the spreading pipe 16 according to, for example, the width of the web of material being treated, inside the spreading pipe 16 at both ends there have been fitted pistons 24 movable reciprocally in the longitudinal direction, the pistons being moved by means of piston rods 23 fitted through the ends of the spreading pipe 16. The flexible connecting tubes 26 between the size feed pipe 15 and the spreading pipe 16 are in this case connected to the spreading pipe 16 at points which are within the range of the smallest effective sizing width.

Figure 7:
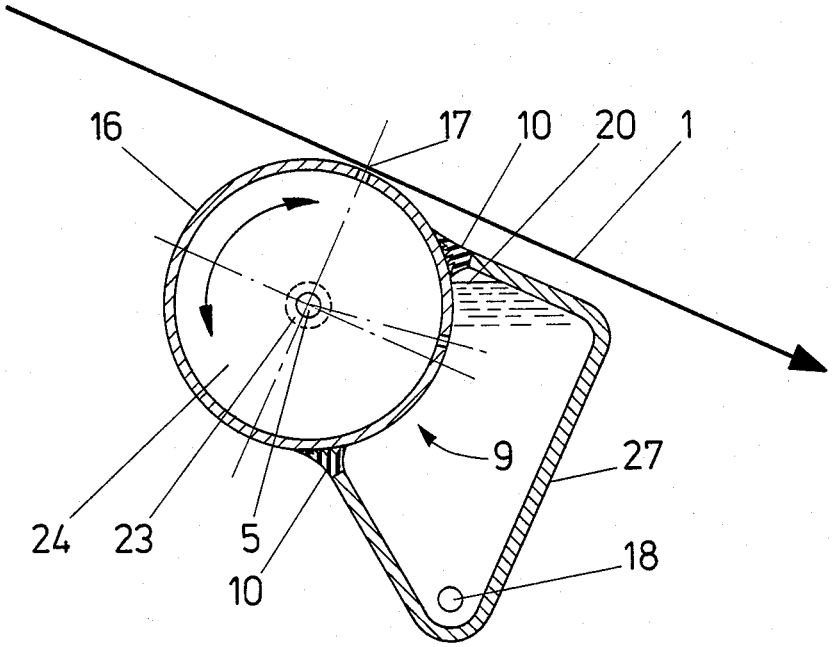
FIG. 7 is a cross sectional side view of a structurally very simple embodiment of the invention.

In the very simple embodiment depicted in FIG. 7, the spreading pipe 16, turnable about its longitudinal center line, is fitted tightly over the opening 9 of the trough 27 adjacent to it, the side edges of the opening 9 having seals 10. In this case, the opening 9 of the trough 27 is shorter than the spreading pipe 16, but at minimum as long as the opening or row of openings 17 in the spreading pipe 16.

The trough 27 is filled with a fluid, the surface of which is indicated by reference numeral 20. The fluid is introduced into the trough 27 via an inlet 18 in the lower part of one of its ends and is removed from an opening in the upper part of its opposite end, this opening being not shown in this cross section.

The fluid being spread is directed via bores 5 in the piston rods 23 of the pistons 24 at the opposite ends of the spreading pipe 16 into a space delimited by the pistons 24 in the spreading pipe 16. The bores 5 have been in this case fitted so as to close when the pipe 16 turns to that extreme position in which the row of openings 17 on its circumference opens into the trough 27.

Figure 8:
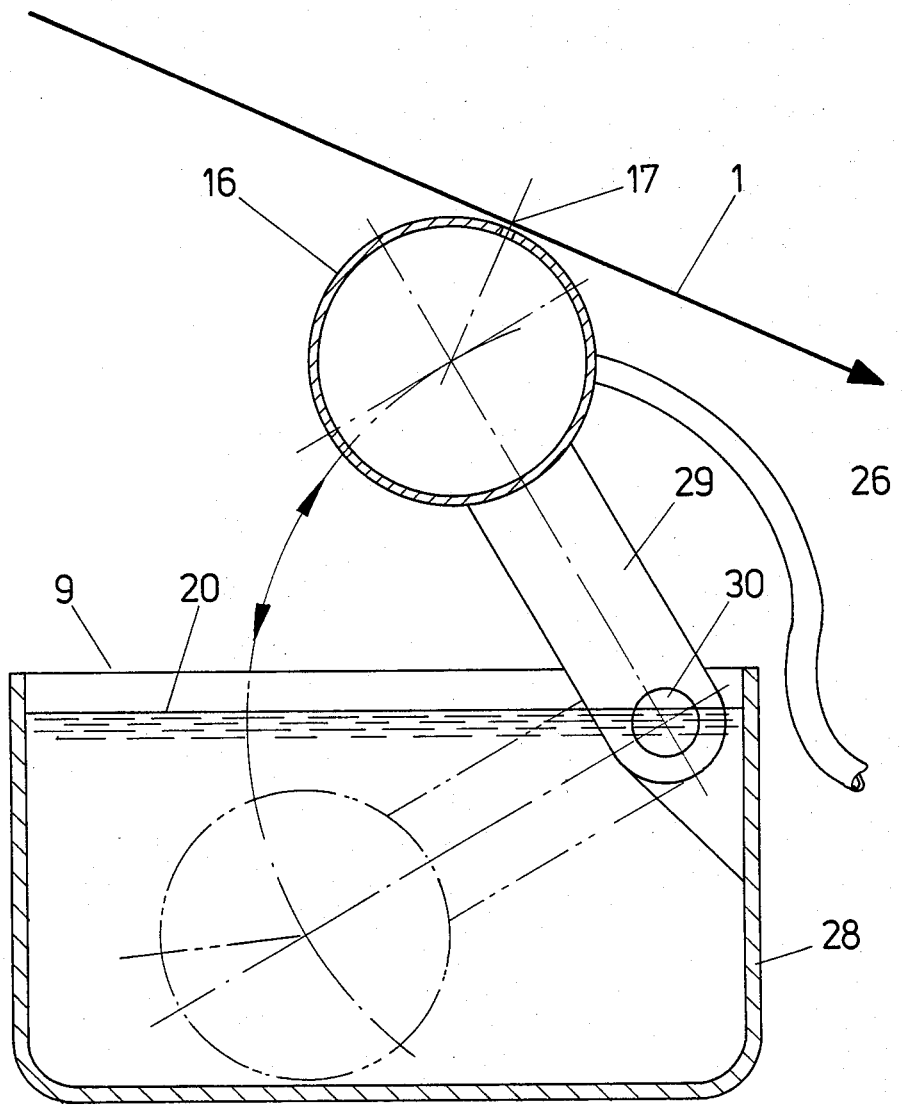
FIG. 8 depicts a cross sectional side view of an alternative embodiment.

In the embodiment depicted in FIG. 8 the trough constitutes a tank 28 filled with the said other fluid, the tank being open 9 upwards. The spreading pipe 16 can be moved from its upper position against the moving web of material 1 to an immersed position below the surface 20 of the fluid in the tank 28 by means of a transverse lever arm 29, one end of which is attached to the spreading pipe 16 and the opposite end articulated to the tank 28 so as to turn about a shaft 30 parallel to the spreading pipe 16. In this case the spreading pipe 16 is connected by means of one or several flexible hoses 26 to the source of the fluid being spread. It is evident that the spreading pipe 16 can equally well be articulated directly to the tank 28, without the lever arm 29. The tank 28 can be filled and emptied of the said other fluid at regular intervals by means of separate filling and emptying devices, which are not shown in FIG. 8.

What we claim is:

1. An apparatus for spreading a fluid onto a moving web of material, comprising:

an elongated trough extending along a longitudinal axis, having an elongated opening in a peripheral surface thereof and containing a first fluid;

a pipe, extending parallel to said longitudinal axis and having at least one aperture therein for spreading a second fluid in said pipe onto the moving web of material, said aperture being smaller than said opening, said pipe being movably coupled to said trough for movement between a first position in which said aperture is spaced from said first fluid and a second position in which said aperture is submerged in said first fluid;

first means for conveying said first fluid into and out of said trough;

second means for feeding said second fluid into said pipe; and means for moving said pipe between said first and second positions.

2. An apparatus according to claim 1 wherein said pipe is mounted inside said trough.

3. An apparatus according to claim 1 wherein said pipe is mounted adjacent said trough.

4. An apparatus according to claim 1 wherein said pipe is movably mounted inside said trough; said means for moving supports and guides said pipe such that said pipe extends through said opening in said first position and said pipe is within said trough in said second position; and said second means comprises a hose coupled to said pipe and to said trough opposite said opening and means for connecting the inside of said hose to a pressure medium source.

5. An apparatus according to claim 4 wherein said means for moving comprises a linearly movable cradle mounted between said pipe and said trough, said cradle having a concave surface facing said pipe with a transverse cross-sectional radius of curvature substantially equal to that of an outer surface of said pipe.

6. An apparatus according to claim 1 wherein said pipe is circular in transverse cross-section and has a central axis; and said means for moving rotates said pipe about said central axis.

7. An apparatus according to claim 6 wherein said means for moving comprises a linearly movable cradle mounted between said pipe and said trough, said cradle having a concave surface facing said pipe with a transverse cross-sectional radius of curvature substantially equal to that of an outer surface of said pipe.

8. An apparatus according to claim 1 wherein said pipe comprises piston means, located at least at one longitudinal end of said pipe and reciprocally and longitudinally movable relative to said pipe, for adjusting an effective length of said pipe to a desired spreading width.

9. An apparatus according to claim 8 wherein said second means is coupled to said pipe within the range of a minimum effective length of said pipe.

10. An apparatus according to claim 1 wherein said opening of said trough has a length at least as great as said pipe and has a width permitting a portion of said pipe to fit between longitudinal side edges of said opening, said trough comprising a resilient membrane covering said opening and having a longitudinal slit therein.

11. An apparatus according to claim 1 wherein said trough comprises an upwardly open tank; and said means for moving comprises a lever arm attached at one end by bearings for pivotal movement about a horizontal axis parallel to said tank and at another end to said pipe for moving said pipe adjacent the moving web of material in said first position and inside said tank in said second position.

12. An apparatus according to claim 1 wherein said first means comprises an inlet in a lower part of said trough and an outlet in an upper part of said trough, said outlet located above said aperture in said second position of said pipe.

13. An apparatus according to claim 1 wherein said trough comprises means for moving said trough toward and away from the moving web of material.

* * * * *